United States Patent [19]

Weidler, Jr.

[11] 4,014,176

[45] Mar. 29, 1977

[54] METHODS AND APPARATUS FOR APPLYING BUOYANT FORCES TO OFFSHORE TOWER LEGS AND PROVIDING AND ENCLOSING BUOYANCY CHAMBERS

[75] Inventor: Jay B. Weidler, Jr., Houston, Tex.

[73] Assignee: Brown & Root, Inc., Houston, Tex.

[22] Filed: Sept. 4, 1975

[21] Appl. No.: 610,277

[52] U.S. Cl. ..... 61/87; 61/94; 61/97

[51] Int. Cl.[2] ..... E02B 17/00

[58] Field of Search ..... 61/46.5, 87, 94, 97

[56] References Cited

UNITED STATES PATENTS

| | | | |
|---|---|---|---|
| 3,209,544 | 10/1965 | Borrmann | 61/46.5 |
| 3,224,402 | 12/1965 | Kobus | 61/46.5 X |
| 3,815,372 | 6/1974 | Mott | 61/46.5 |

*Primary Examiner*—Jacob Shapiro
*Attorney, Agent, or Firm*—Kenway & Jenney

[57] ABSTRACT

Improvements in buoyancy structures independently comprising each of a radiating, circumferentially extending buoyancy cell network encircling an offshore jacket leg, and a double-walled buoyancy chamber wall fabricated from a shell and overlapping pipe segments bonded thereto.

An offshore platform jacket assembly is disclosed in which a plurality of jacket legs are anchored by piling members to the bed of a body of water. A buoyancy unit is disposed at a lower portion of the jacket in association with at least one of the jacket legs. Each buoyancy unit comprises a chamber disposed around its respective leg. Each chamber is divided into a plurality of circumferentially displaced, radiating cells and these cells are disposed inwardly of a periphery defined by a series of piling guides spaced around the leg. A plurality of generally upright divider fins extend radially outwardly from the leg to divide the chamber into the radiating cells which are arranged about the leg for the reception of a buoyant medium. The fins are operably connected to the piling guides to transmit forces in a generally uniform manner between the leg and the piling guides.

In one preferred embodiment, the buoyancy cells are of less than water-tight construction and are filled with a buoyancy-generating foam.

In another preferred embodiment of the invention, the buoyancy cells are of water-tight construction and are reinforced by a double-wall construction which includes overlapping pipe segments, welded to the interior periphery of a chamber-defining shell situated around the tower leg.

A double-walled buoyancy chamber including a shell wall and an edge overlapping network of pipe segments bonded thereto.

16 Claims, 9 Drawing Figures

METHODS AND APPARATUS FOR APPLYING BUOYANT FORCES TO OFFSHORE TOWER LEGS AND PROVIDING AND ENCLOSING BUOYANCY CHAMBERS

BACKGROUND AND OBJECTS OF THE INVENTION

This invention relates to offshore platforms and, more particularly, to buoyancy units carried by the jackets for such platforms.

Offshore activities are being conducted with growing frequency in diverse scientific and industrial endeavors, such as ocean exploration and research, oil recovery, weather reporting, and radar defense, for example. In order to carry out these activities, large platforms or tower installations are being erected at offshore sites. Depending upon their location, such platforms can be on the order of two or three hundred feet or more in length. Consequently, very formidable problems exist in connection with platform fabrication as well as transportation and installation of the platform at its operating site.

Problems of this nature are discussed for example in U.S. Pat. Nos. 3,585,801 (Koehler — June 22, 1971), 3,668,876 (Koehler — June 13, 1972), 3,693,361 (Koehler — Sept. 26, 1972), 3,823,564 (Crout et al — July 16, 1974) and 3,859,804 (Koehler et al, — Jan. 14, 1975), all of which are assigned to the assignee of the present invention. The subject matter of these patents is incorporated herein by reference as if set forth at length. These patents discuss various techniques intended to overcome or alleviate fabrication, transporation and installation problems.

For instance, one accepted technique for installing a platform involves the floating of a prefabricated platform jacket to the operating site in a generally horizontal posture. (A "jacket" constitutes the basic platform framing which is usually connected at its lower end by piling to a submerged surface and which supports a deck structure at its upper end.) Once at the site, the jacket is turned to an upright condition by appropriate ballasting of the tower and/or a transport structure, i.e., the bottom of the jacket is moved down through the water, so that the jacket assumes a generally upright posture. As is explained in U.S. Koehler et al., Pat. No. 3,859,804 (Jan. 14, 1975), incorporated herein by reference, during this jacket installation procedure there may be a tendency for the jacket structure to roll about its own longitudinal axis or to make other potentially dangerous movements as it gains momentum while swinging through the water. It has been found that the effects of "roll" can be minimized by performing the installation operation in a relatively rapid manner. In so doing, however, it becomes necessary to maintain control over the jacket to prevent the buildup of great momentum which could endanger the safety of adjacent ships and personnel. In furtherance of this end, it has been proposed by Koehler et al that watertight buoyancy spheres be attached to a pair of the jacket legs. The buoyancy spheres tend to brake the speed of the jacket as the latter swings through the water and control pitch and roll.

Once the jacket has been launched, ballasting of the buoyancy spheres and the jacket legs causes the jacket to descend in a generally vertical manner through the body of water. When the jacket has come to a rest on the waterbed, piling members are driven through piling guides carried by the jacket legs to pin the jacket to the waterbed.

While launching operations as outlined above have been successfully practiced, room for improvement remains. For example, it would be desirable to provide a jacket with pitch and roll resisting and possibly momentum-braking buoyancy equipment which could be employed with or in lieu of the previously described buoyancy spheres in a manner which would provide a compact or streamlined tower construction so as not to render the tower so unwieldy that it becomes more difficult to transport or launch. In addition, it would be useful to provide buoyancy equipment which applies a highly uniform transfer of forces between the jacket legs and the anchoring piles. Also, it would be advantageous for such buoyancy equipment to exert buoyancy forces without necessarily having to withstand large hydrostatic pressures that may be present. In other instances, where performance criteria require that such hydrostatic pressure forces be resisted, it would be desirable for the buoyancy equipment to be reinforced in an effective yet inexpensive and uncomplicated manner.

It is, therefore, an object of the present invention to overcome problems and achieve advantages set forth above.

It is another object of the invention to provide novel, more facile and economical methods and apparatus for exerting buoyant forces on an offshore tower such as a platform jacket.

It is a further object of the invention to provide such methods and apparatus which effectively controls tower motion during launching and installation operations.

It is another and independent object of the invention to provide such methods and apparatus which exerts buoyant forces on the tower absent the need for withstanding hydrostatic forces.

It is yet a further and independent object of the invention to provide apparatus which exerts buoyant forces on the tower while being effectively reinforced and sealed by way of a double-walled shell and pipe segment structure.

Still another independent object of the invention is to provide a tower buoyancy unit which utilizes a series of cells circumferentially disposed around a tower leg. The cells can be less than water-tight and filled with buoyant foam. Alternatively, the cells can be watertight and include a novel double wall reinforced construction to resist hydrostatic forces and provide unique resistance to leakage.

SUMMARY OF THE DISCLOSURE

Certain of the foregoing objects are achieved by an offshore tower comprising a platform jacket assembly including a plurality of legs and a plurality of piling guides disposed around and connected to at least one of the legs. The piling guides are dimensioned to receive piling members for anchoring the legs to the bed of a body of water. At least one buoyancy unit is disposed at a lower portion of the tower. This buoyancy unit comprises wall portions defining chamber means extending around a jacket leg, and a plurality of generally upright divider fins extending generally radially outwardly from the leg. The fins divide the chamber means into a plurality of buoyancy cells arranged around the leg for reception of a buoyant medium. The fins are operably connected to the piling guides to transmit forces in a generally uniform manner between the legs and the piling guides connected thereto.

In one preferred embodiment of the invention, the buoyancy cells are of less than water-tight construction and are filled with a buoyant foam.

In another preferred embodiment of the invention, the cells are of water-tight construction and are reinforced by a series of curved plates. A plurality of first curved plates are connected to an inner surface of an outer wall above the chamber. A plurality of curved bridging plates are connected to convex surfaces of the first plates. The cells may be filled with a suitably buoyant fluid under pressure.

The present invention also involves a method of applying buoyant forces to at least one leg of an offshore tower such as a platform jacket by providing a plurality of buoyancy cells around the bottom of a tower. The cells are disposed within a perimeter defined by piling guides that are located outwardly of the leg. A buoyant medium is inserted within the cells and the buoyant forces thereof are transmitted in a generally uniform manner to the leg through fins secured between the leg and the cells.

In an independent sense, the invention further contemplates a unique, double-walled buoyancy chamber including a shell means and a series of overlapping pipe segments or curved plates bonded thereto.

THE DRAWINGS

Other objects and advantages of the present invention will become apparent from the subsequent detailed description thereof in connection with the accompanying drawings in which like numerals designate like elements, and in which:

FIG. 1 is a side elevational view of an offshore tower platform anchored to the bed of a body of water;

FIGS. 2*a* through 2*c* provide schematic illustrations of postures that are sequentially assumed by the tower jacket during its uprighting and installation onto the submerged bed of a body of water;

DETAILED DESCRIPTION OF THE PREFERRED EMBODIMENT

Jacket and Deck Structure

Figure 1:
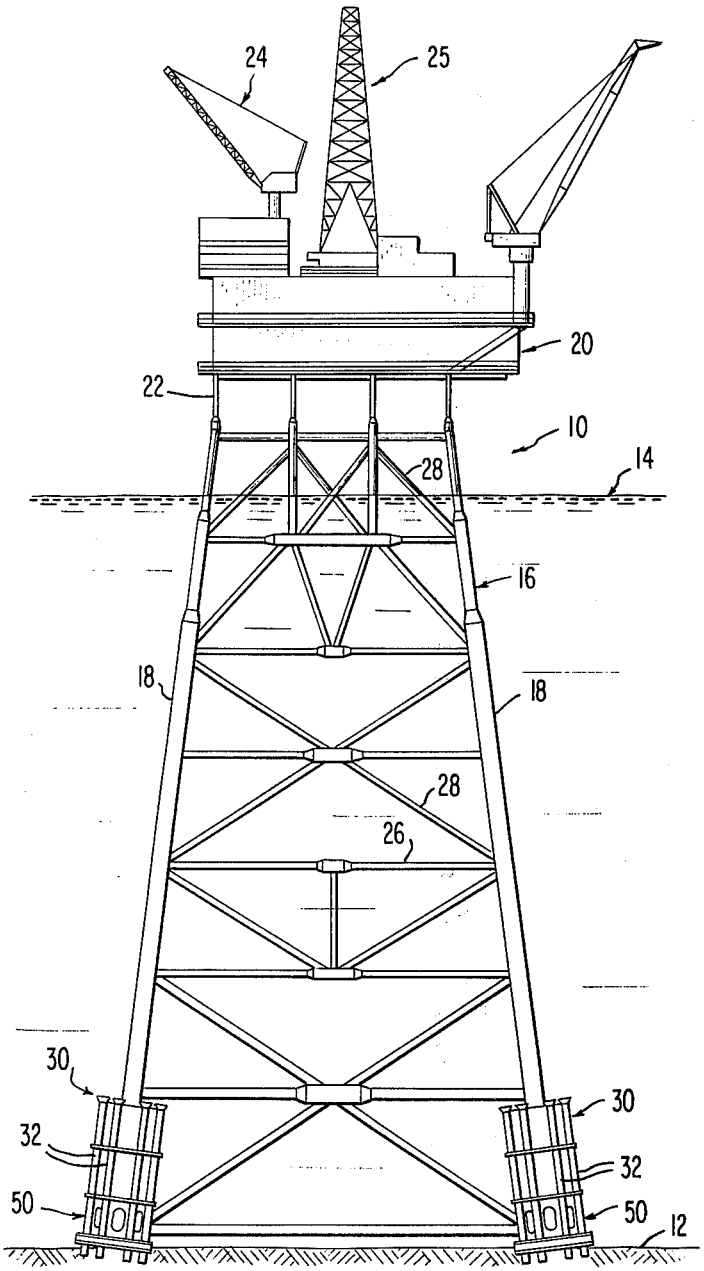

Referring now to the drawings, and more particularly to FIG. 1, a steel frame offshore tower 110 is illustrated in an upright, erected posture on the bed 12 of a body of water 14. This tower comprises a platform of the type used in offshore oil and gas operations.

The tower 10 includes a support frame or jacket structure 16 comprising a plurality of upright supporting columns or legs 18 which typically slope inwardly and upwardly. The legs are axially dimensioned to extend between the waterbed 12 and the water surface for supporting an operating deck 20 above the water surface.

The deck 20 is connected to the tower legs 18 by means of generally vertical riser columns 22 which ensure that the deck is sufficiently elevated above the water surface.

The platform 10 may be utilized in operations dealing with offshore oil, such as drilling, producing, storing, and/or distributing oil. As shown in FIG. 1, where platform or tower 10 is used for drilling operations, the deck 20 may support one or more pedestal cranes 24, a drilling derrick 25, and other equipment suitable for sustaining continuous oil drilling operations.

To support the significant loading acting on the platform 10, the supporting legs of the jacket 16 are laterally stabilized by a plurality of transversely extending brace members 26. A network of diagonal struts 28 interconnect the braces 26 and the jacket legs 18 to distribute tower loading throughout the structure. The cross-sectional size of the jacket legs 18 may increase in a downward direction to compensate for the progressively increasing load which must be sustained.

At the base of the legs 18, anchoring assemblies 30, 31 (FIG. 2*a*) are provided which receive anchor pilings to secure the jacket legs to the waterbed 12 in conventional fashion.

Jacket Installation

Figure 2A:
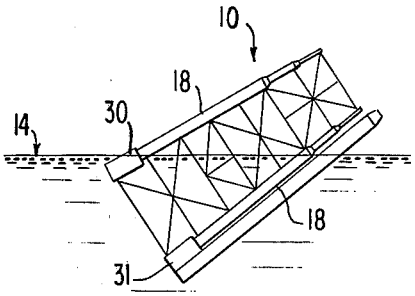
Figure 2B:
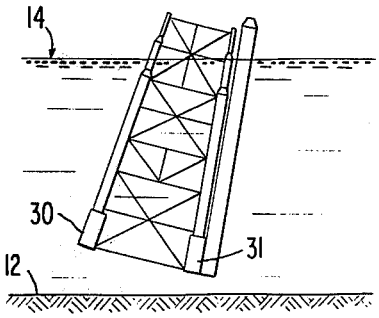
Figure 2C:
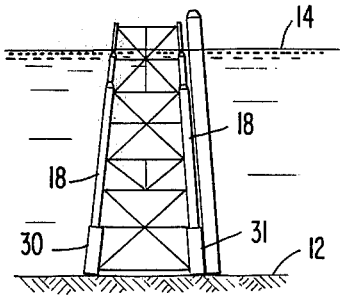

Towers of this type, as noted previously, are of such large size and weight that they present formidable problems relating to the transportation and installation procedures. The tower jacket is preferably pre-fabricated at a remotely located facility and is then floated (via buoyancy units or by a barge) to the on-site location for installation. Installation procedures involve allowing the jacket to swing to an upright position within the water as depicted in FIGS. 2*a*–2*c*.

It will be readily apparent that a structure of the great size and weight of a typical offshore platform jacket poses considerable danger in the event that sudden unexpected movements of the jacket should occur. For this reason, it is extremely important that adequate control be maintained over the jacket structure as it is being launched and turned upright in the water and installed on the waterbed 12. Desirably such control will resist pitching and rolling of the jacket and may desirably also slow jacket movements during uprighting and lowering operations.

As discussed in the previously mentioned Koehler et al U.S. Pat. No. 3,859,804, buoyancy spheres can be positioned to impose movement controlling forces on the jacket as the jacket is being uprighted and lowered. The buoyancy tanks can be selectively ballasted and deballasted to regulate the degree of buoyancy being applied.

Buoyancy spheres of this nature have proven to be highly successful in controlling jacket movement during jacket installation. Also, once the jacket is upright, such tanks can be selectively ballasted and deballasted to impose a selected buoyancy pattern on the jacket legs to aid in leveling the tower.

Buoyancy Unit Structure — Generally

The present invention involves the provision of buoyancy units which can be utilized in place of or in conjunction with buoyancy spheres to control jacket behavior. As will be discussed, the buoyancy units are very compactly integrated with the jacket anchoring structure and add only minimal weight or size to the jacket. In this fashion, greater control over pitching, rolling, excessive movement, etc., is provided without unduly burdening the fabrication, transporting, or launching operations.

Figure 6:
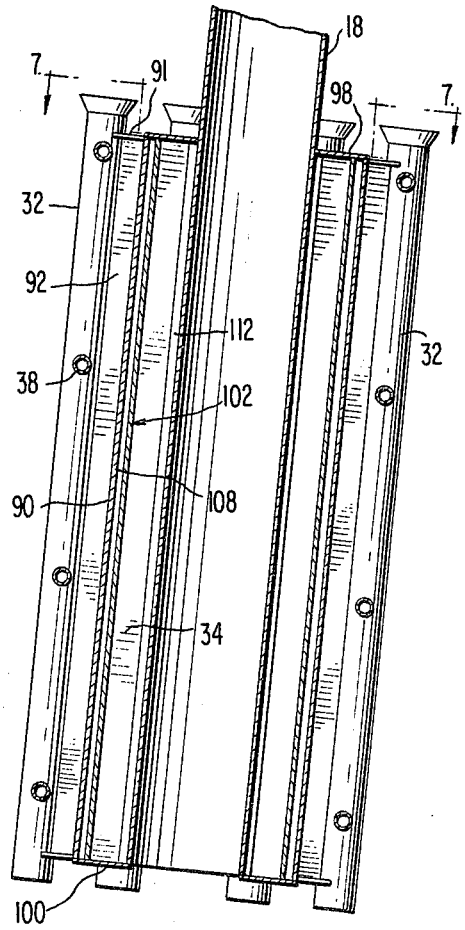
FIG. 6 is a longitudinal sectional view of another preferred buoyancy unit, illustrating a unique double-walled buoyancy chamber.
Figure 7:
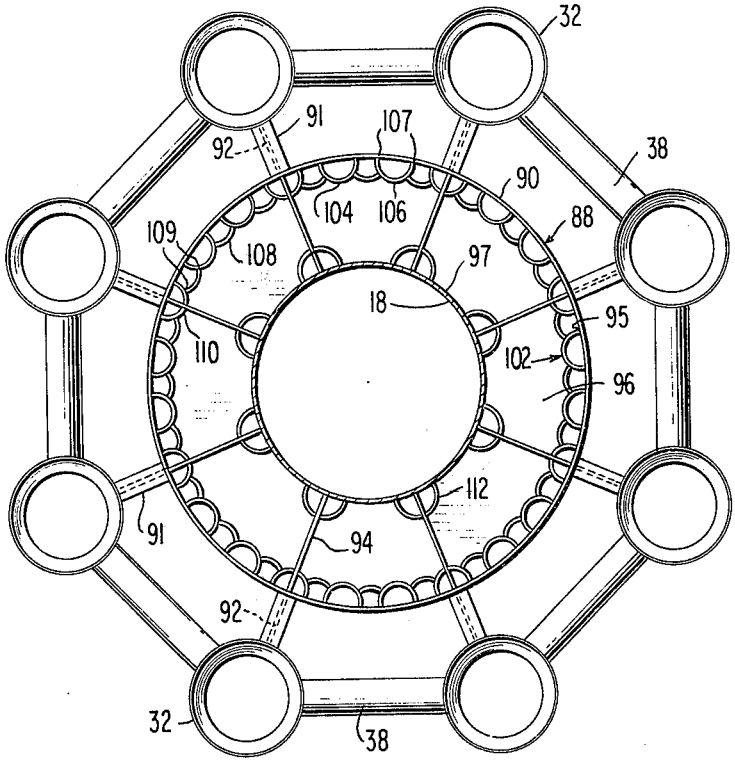
FIG. 7 is a cross-sectional, reduced scale, view of the double-walled buoyancy unit depicted in FIG. 6, as viewed along section line 7—7.

In one embodiment of the invention, the buoyancy units functions absent the need for resisting large hydrostatic forces (FIGS. 1, 3, 4 and 5). In another embodiment, a novel double-walled reinforcing structure is provided for strengthening the buoyancy unit so as to enable the unit to withstand such hydrostatic forces and afford multiple barriers to penetration of the buoyancy unit (FIGS. 6 and 7).

First Embodiment — Cellular Foam Buoyancy

Referring to FIGS. 1 and 2*a*, jacket-anchoring assemblies 30, 31 are provided at the base of the jacket legs 18. Anchoring assemblies 31 are located on the jacket legs which initially engage the water surface during installation (i.e., lower legs while jacket is horizontal), while anchoring assemblies 30 are located on the jacket legs which subsequently engage the water surface during uprighting (see FIGS. 1, 2*a*–2*c*)(i.e., upper legs while jacket is horizontal).

In this connection, see the disclosure of Koehler et al. U.S. Pat. No. 3,859,804, above noted for a full description of the jacket uprighting and lowering technique here envisioned.

Figure 3:
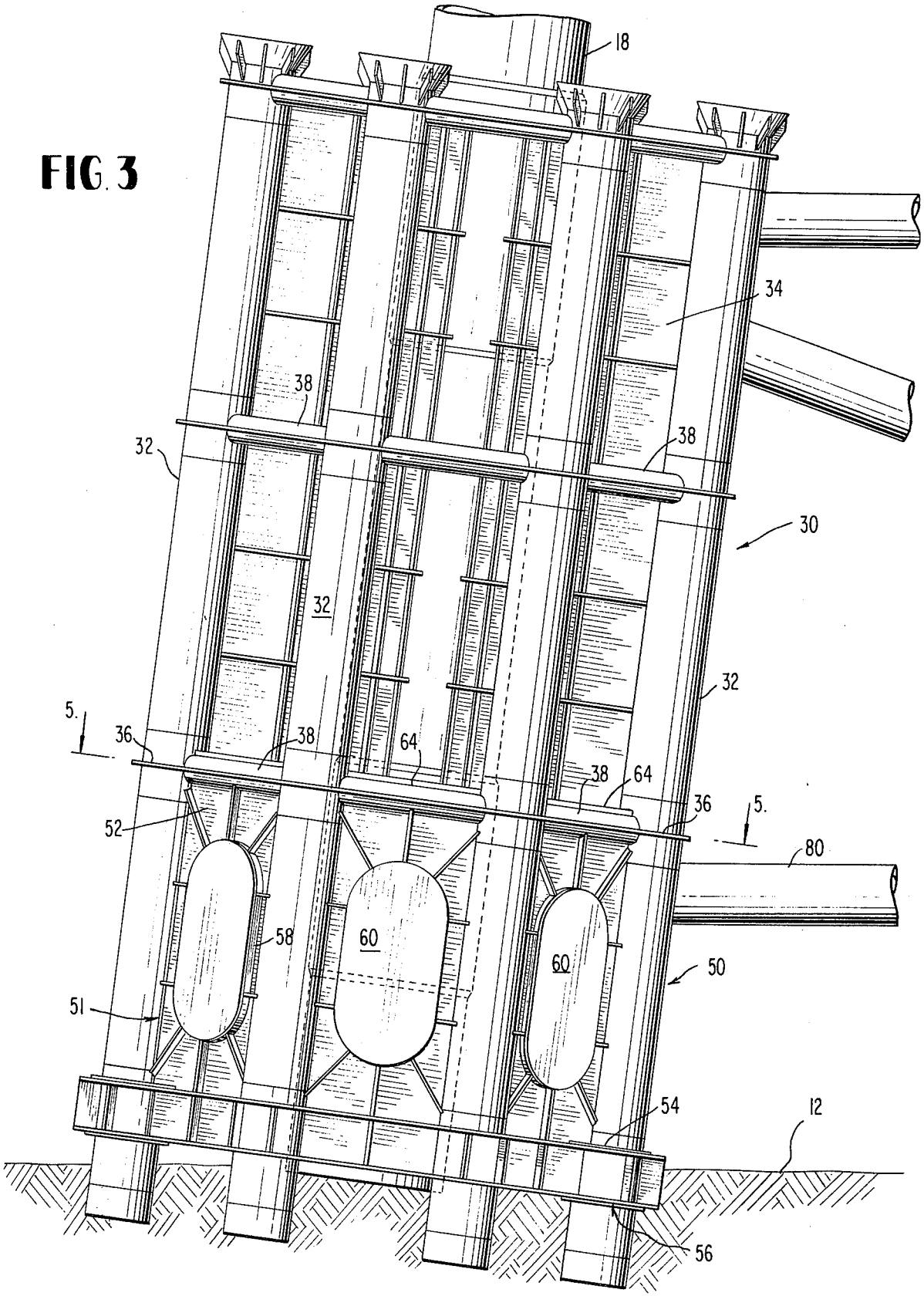
FIG. 3 is a side elevational view of a lower portion of a tower jacket leg, depicting one preferred form of buoyancy unit according to the present invention.
Figure 4:
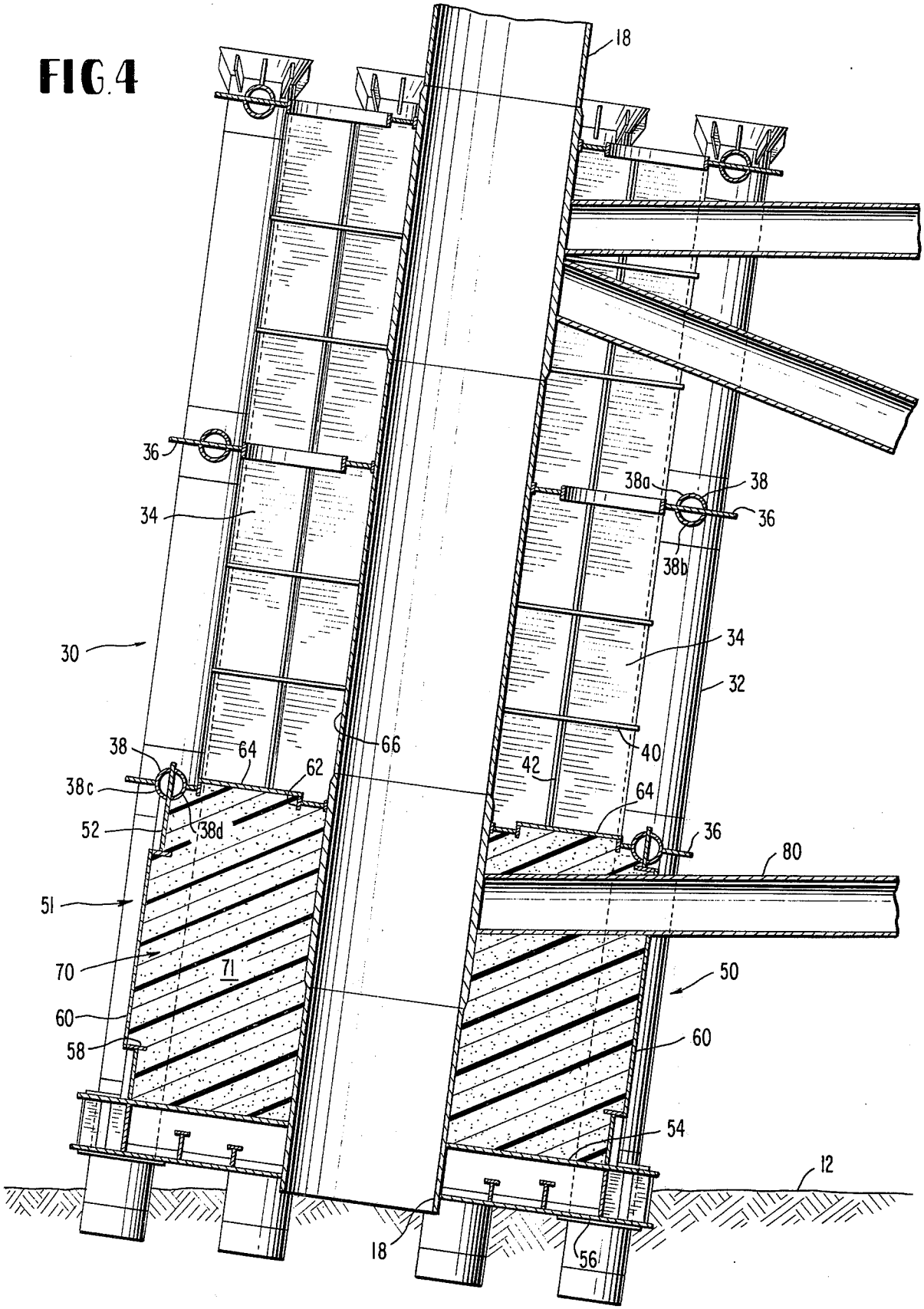
FIG. 4 is a longitudinal sectional view of the buoyancy unit depicted in FIG. 3.

The anchoring assemblies 30 will be described in connection with the cellular foam buoyancy unit of the invention. A representative anchoring assembly 30 is depicted in FIGS. 3 through 5.

The anchoring assembly 30 includes an array of piling guides 32 which comprise steel tubular elements that are sized to telescopingly receive steel anchor pilings. The pilings (not shown) are driven into the waterbed 12 and are then bonded to the piling jackets 32, as by grouting or the like (see, for example, FIG. 1 of Koehler et al. U.S. Pat. No. 3,859,804). As a result, the piling guides 32 and the jacket 16 are securely pinned to the submerged earth formation 12. A plurality of inner piling guides 33 may also be employed for receiving pilings in a known fashion. Such guides 33 are shown in FIG. 5.

Figure 5:
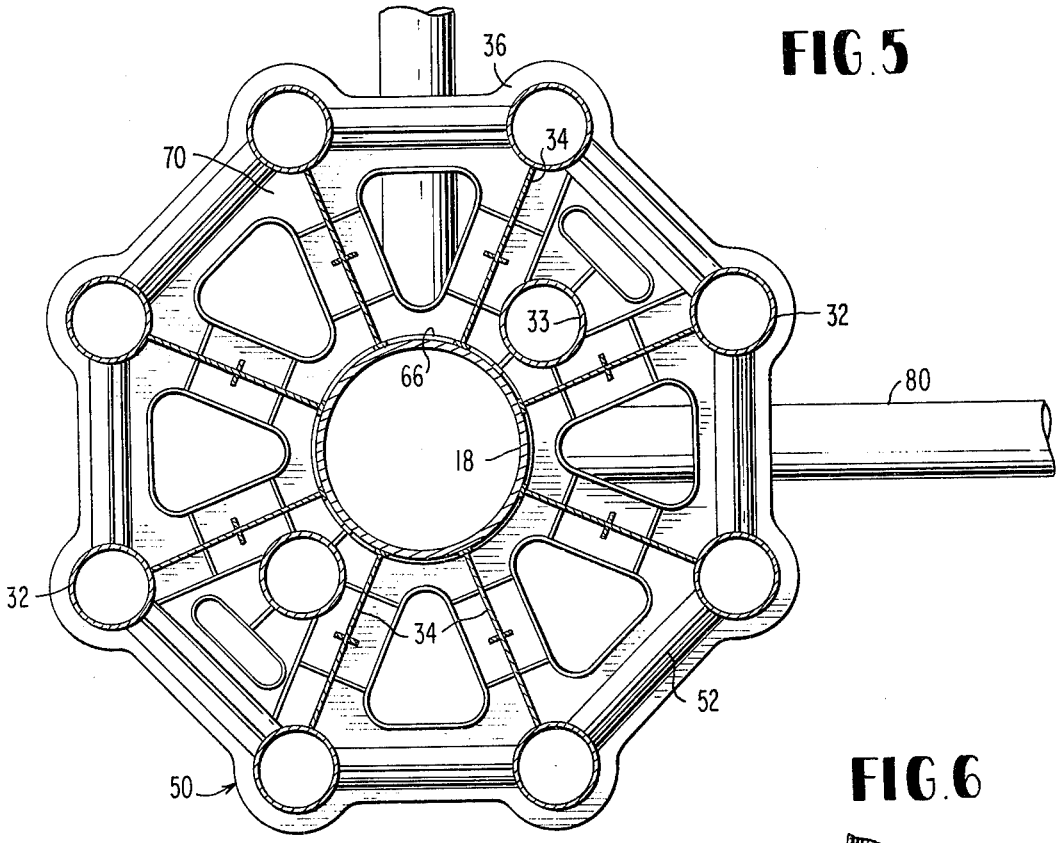
FIG. 5 is a cross-sectional view taken along line 5—5 of FIG. 3.

Radiating outwardly from the base of each cylindrical leg 18, possibly at 45° intervals, are a series of upright load-transfer fins 34 (FIG. 5). Each fin 34, fabricated of steel, is rigidly welded to a leg 18 and to one of the piling guides 32. The fins extend in a generally vertical direction along a substantial extent of the piling guides 32. The arrangement of the fins 34 is such that vertical loading between the leg 18 and the piling guides 32 is transmitted generally uniformly around the periphery of the leg 18.

Interposed at spaced locations along the height of the load-transfer fins at right angles to the longitudinal axis of the leg 18 are generally transverse diaphragm plates 36 which reinforce the connection between the piling guides.

Diaphragm plates 36 are apertured to receive the pile guides 32 and 33 and the leg 18 and may be welded to these tubular components. Additional apertures 62 (which may be flange rimmed) are also provided and will be subsequently discussed.

The piling guides are interconnected and braced by a plurality of peripheral tubular segment struts 38 which are welded at selected levels along the height of the piling jackets so as to define a polygonal, peripheral reinforcing network. As shown in FIG. 4, struts 38 may comprise segments 38*a* and 38*b* disposed above and below a diaphragm plate means 36 or may comprise segments 38*c* and 38*d* which intersect and are welded to the plate means 36 on opposite sides of peripheral wall means 52 to be subsequently discussed.

Horizontal and vertical stiffener web elements 40, 42 can be provided between the leg 18 and the respective piling guides to provide further reinforcement of the structure (FIG. 4).

Adjacent the lower end of each anchoring assembly 30 is a buoyancy unit 50. Each buoyancy unit 50 comprises an outer wall 51 which extends around its associated leg 18 in a spaced relation therefrom. The outer wall 51 includes a plurality of peripheral wall means or panel sections 52 welded to adjacent piling guides 32. The upper ends of the wall panels 52 are connected to cross struts 38, and the bottom ends are connected to a floor plate 54. The floor plate 54 forms part of a base structure 56 which is attached to the tower leg 18 and the piling guides 32.

The outer wall panels 52 contain rim-reinforced openings 58 which can be sealed by perforate cover plates 60. The diaphragm plates 36 may also contain the aforesaid rim-reinforced apertures 62 which can be closed by welding metal sheets or closures 64 thereacross.

It will be apparent that the outer wall 51, the floor plate 54 and a diaphragm plate means 36 define a generally cylindrical compartment means or chamber means extending about an outer surface 66 of the tower leg 18. This compartment means is divided into individual cells 70 by the load transmission fins 34.

The apertures 62 provide access to the cells 70 and enable a solid buoyancy medium, such as a polyurethane foam 71 for example (FIG. 4), to be inserted into the cells. The foam is buoyant, defines a closed cell foam network, and may be installed by pumping fluid foam into the cells 30 where it is allowed to "harden" or set. This installation may be effected via multiple layers of foam. After the foam is installed and hardened, the cell opening closure plates 64 may be installed.

The density (and thus the strength) of the foam may be selected in accordance with water depth. A polyurethane foam having a density of 12 lb. per cu. ft. is believed to be satisfactory where the water depth of unit 50 is about 400 feet.

If foam is initially installed in the cells 70 in the form of solid blocks or sheets, the openings 58 and covers 60 provide suitable access to the cell interiors.

The foam-containing cells 70 apply upward buoyancy forces to the tower leg when the jacket leg is disposed in water. These buoyancy forces are applied generally uniformly around the periphery of the jacket leg due to the radiating and leg-encircling cell design of the buoyancy unit 50.

One or more of the plates 60, 64 or other peripheral wall means of the cells 70 may be perforated to admit water into the cells 70. (However, such openings should be located, sized and/or formed so as not to interfere with the initial installation of foam where the fluid foam installation technique is employed.) In this fashion, pressure within the foam-holding cells 70 may be equalized relative to the surrounding environment. Thus, despite the presence of large hydrostatic pressures surrounding the buoyancy cells 70, the equalized pressure relationship eliminates the need for heavy duty reinforcement of the cell peripheral walls.

The height of the cells 70 can be selected so as to achieve the desired buoyancy effect, and may be only partly, or even fully, co-extensive with the height of the anchoring unit 30.

The unique cellular formation of the buoyancy assembly readily accommodates a brace pipe or strut 80 which is attached between adjacent jacket legs 18. As depicted in FIG. 5, the pipe 80 may project through an aperture 58 in one of the side wall panels 52. The cover plate 60 associated with this aperture may be suitably configured to peripherally conform to the shape of the pipe 80.

If the buoyancy assembly 50 is utilized in conjunction with flotation spheres of the type discussed in the aforementioned Koehler et al patent, then it may be convenient to extend support struts for the spheres through apertures 58 of the wall panels, and/or through the apertures 62 of the diaphragm plates 36. Apertures so used would be covered by appropriately shaped cover plates.

It will be appreciated that the buoyancy unit 50 is effectively integrated with the anchoring assembly so as to add little bulk or size to the tower. The buoyancy unit is located within a perimeter defined by the piling guides 32 and thus the cells 70 are afforded a considerable amount of protection from damage. Moreover, due to the arrangement wherein the buoyancy cells are divided by the fins 34, the buoyant forces developed by the synthetic foam located within the cells are uniformly distributed around the base of the tower legs and are applied in a generally uniform manner to the tower legs. These advantages are achieved without requiring heavy duty reinforcement of the cells 70 against hydrostatic pressures, since the cells are not water-tight.

In addition, the cellular formation of the buoyancy unit 50, i.e., the provision of circumferentially displaced cells 70, enables selected ones of the cells 70 to be supplied with foam, if an uneven buoyant force pattern is deemed desirable.

Second Embodiment — Double-Walled Buoyancy Chambers

In many instances, it may be desirable to utilize buoyancy units where the buoyancy may be selectively adjusted and the units are thus of water-tight construction. Such a construction enables the buoyant forces being applied to the associated jacket legs to be selectively varied, as required by operating conditions.

A water-tight buoyancy assembly 88, depicted in FIGS. 6 and 7, which may be used in units 30 or 31 instead of unit 50, includes a cylindrical outer steel wall or shell 90 disposed radially inwardly of the piling guides 32. The piling guides 32 may be interconnected by tubular segment struts 38 and be rigidly bonded to the shell 90 by vertical and radial flanges 92 which are welded between the tubular piling guides 32 and the outer surface of the shell 90. Reinforcing webs 91 may be coupled to the shell and the jackets at the tops and bottoms of the flanges 92.

The shell 90 is connected to the jacket leg 18 by upright, radial fins 94 which are welded to the inner surface 95 of the shell 90 and to the outer surface 96 of the leg 18 and project radially of the longitudinal axis of this leg. It will here be realized that the shell 90 defines a compartment laterally surrounding the jacket leg 18. The fins 94 divide the compartment into a series of circumferentially displaced, radiating cells 96 around the leg 18. The cells are of truncated triangular cross-section and are closed at their upper and lower ends by means of top and bottom plates 98, 100 to produce a water-tight seal around the cells (FIG. 6).

A suitable conventional pressurizing system can be provided for delivering pressurized air or water to the cells and for exhausting air or water therefrom so as to control cell buoyancy. Such buoyancy-control systems may be diver-operated or operated by remote control and are generally described in the aforesaid Koehler et al and Crout et al patents and now well known in the offshore art. If desired, the fins 94 can be perforated to provide fluid communication between cells. By virtue of such an arrangement, the buoyancy unit 88 can be selectively ballasted and deballasted to facilitate tower uprighting, lowering, leveling, etc.

In order to enable the unit 88 to withstand the large hydrostatic forces that may be encountered, this unit 88 is provided with a novel, double-walled, internal reinforcement arrangement.

More particularly, a plurality of curved plates are bonded in place to define an internal, "scalloped" reinforcing wall means 102 extending along the inner surface 95 of the shell 90. The curved plates defining this wall means preferably comprise longitudinal segments of steel pipe which are installed in circumferentially overlapping relationship.

In this connection, a plurality of first pipe segments 104 (nearly semi-circular in cross-section) are disposed in circumferentially spaced relationship about the inner surface of the shell 90. To the outer or convex surfaces 106 of these first segments are connected a plurality of second, bridging pipe segments 108. The segments 104 are larger in arcuate extent than segments 108 and are preferably fillet welded at each longitudinal edge 107 thereof to the inner surface 95 of shell 90. The bridging pipe segments 108 are preferably fillet welded at each longitudinal edge 109 thereof to the convex surfaces 106 of the first segments 108. Moreover, the tops and bottoms of the segments 104 and 106 are welded to top plate 98 and bottom plate 100 so as to seal the interior of these segments.

Suitably, the first segments 104 may constitute a nearly one-half segment of pipe (i.e., the segment defined by the intersection of arcuate wall 95 with the full periphery of the pipes from which these segments are made, passing through the center axes of these pipes) and the bridging segments 108 may constitute approximately a one-fifth segment of pipe. The first segments may be angularly spaced by about 15° between centers thereof, with the centers of the bridging segments 108 being angularly spaced by about 7½° from the centers of an adjacent first segment. It should be understood, however, that pipe segments of varying sizes and angular displacements may be employed.

At the junctions where the fins 94 are connected to the inner shell surface 95, the plurality of first pipe segments can include approximately quarter pipe segments 110 which are each connected at one edge thereof to the inner shell surface 95 and at the other edge thereof to a side of a fin 94. Other suitable arrangements could be employed at such junctions, however. For example, the plurality of first segments could be sized such that the segments located adjacent the junctions of each cell 96 each have an edge thereof welded to the inner shell surface 95 right at the junction. A second pipe segment could then be disposed such that one edge thereof is connected to the convex surface of the first segment adjacent the junction and the other edge thereof is connected to the fin 94.

The novel double-wall construction provided by the shell and plate members 90, 104, 108, having a "scalloped" configuration, provides substantial resistance around the entire periphery of the buoyancy unit 88 against hydrostatic forces acting externally on the buoyancy unit 88. Moreover, such double-wall construction can be conveniently fabricated without the need for precisely dimensioned and precisely placed pipe segments. The fabrication time and costs are thus kept unusually low.

Further internal reinforcement may be provided by approximately quarter pipe segments 112 which are mounted (i.e., welded) at the junctions where the fins 94 are connected to the outer leg surface 97. One end of each such segment 112 may be fillet welded to a fin 94 and the other end fillet welded to the outer surface 97.

The buoyancy units 88 are located within a perimeter defined by the piling jackets 32 and are thus afforded a considerable degree of protection.

Location of Buoyancy Units

It is preferable that the anchoring assemblies 30 which contain buoyancy units 50 or 88 be disposed on legs of the tower which constitute the last legs to enter the water during uprighting of the jacket 16 (see FIGS. *2a–2c*). In this fashion, pitch resistance and rolling resistance and possibly braking action will be imposed on the jacket during jacket installation, particularly after sufficient momentum of the tower has been built up to assure a sufficiently rapid launch. In certain instances, it may be desirable to provide buoyancy units in the anchoring assemblies 31 which initially contact the water, in the event that a slower rate of tower uprighting movement is preferred. In any event, suitable deployment of the buoyancy units 50 or 88 will be readily apparent to those skilled in the art and familiar with this disclosure.

SUMMARY OF MAJOR ADVANTAGES AND SCOPE OF INVENTION

The buoyancy units of the present invention are relatively compact in nature, and thus add little in the way of size or weight to the tower structure.

The units are disposed within a perimeter defined by the piling jackets and thus are well protected and do not present significant problems during transportation.

The plurality of circumferentially displaced but contiguous buoyancy cells spaced around the base of the tower leg and radiating outwardly therefrom affords a generally uniform transmission of force between the tower and the cells. This uniformity of force distribution is facilitated by the radiating transfer fins connected between the jacket legs and the buoyancy cells, which fins also serve to transmit forces generally uniformly between the jacket legs and the piling guides.

By rendering the buoyancy cells of less than water-tight construction and employing a buoyant foam, as in the first embodiment of the invention, the need for the buoyancy units to withstand large hydrostatic pressures that may be encountered during launching and installing is avoided. Consequently, equipment expense and maintenance is reduced.

On the other hand, the reinforced, "scalloped," double-wall, water-tight buoyancy units of the second preferred embodiment of the invention enable the buoyance cells to effectively withstand large hydrostatic pressures. These units, which may be employed in a wide variety of applications and configurations in addition to those disclosed, exhibit a high degree of pressure resistance, yet are of relatively uncomplicated design and are easily and relatively inexpensively fabricated.

The buoyancy units of the present invention are uniquely adapted to be used instead of, or in conjunction with, buoyancy spheres to control tower motion during jacket uprighting and installation operations and are believed to be uniquely facile and economical in nature.

Although the invention has been described in connection with preferred embodiments thereof, it will be appreciated by those skilled in the art that additions, modifications, substitutions and deletions not specifically described but which would be envisioned by those skilled in the art and familiar with this disclosure may be made without departing from the spirit and scope of the invention as defined in the appended claims.

What is claimed is:

1. An offshore tower assembly having a support frame structure arranged to be disposed on the bed of a body of water, said support frame structure comprising:

a plurality of legs;

a plurality of piling guides disposed around and connected to at least one of said legs, said piling guides being operable to telescopingly receive piling members for anchoring said frame structure to said bed of said body of water; and a buoyancy unit disposed at a lower portion of at least said one of said legs, said buoyancy unit comprising walls means defining a chamber encircling said one of said legs, and a plurality of generally upright fins extending generally radially outwardly from said one of said legs to divide said chamber into a plurality of circumferentially displaced buoyancy cells arranged about said one of said legs for the reception of a buoyant medium said fins being connected to said piling guides and operable to transmit forces in a generally uniform manner between said one of said legs and said piling guides connected thereto by way of said fins said plurality of buoyancy cells being contiguous with and radiating outwardly from said one of said legs, being individually operable to define separate, buoyancy medium containing chambers, being circumferentially interspersed between said piling guides;

said plurality of fins defining force transmitting means extending directly between said one leg and said piling guides, and circumferentially alternating with and separating said plurality of buoyancy cells.

2. Apparatus according to claim 1 wherein:

at least one of said wall means is apertured to render said cells less than water-tight; and said cells contain buoyant foam material.

3. Apparatus according to claim 1 wherein:
said wall means includes a cylindrically shaped outer wall;
said apparatus includes reinforcing and penetration-impeding means for said outer wall comprising
a plurality of first, curved plates connected to an inner surface of said outer wall, and
a plurality of second, curved bridging plates connected to convex outer surfaces of said first plates.

4. Apparatus according to claim 1 wherein:
said chamber is disposed within a perimeter defined by said piling guides.

5. An offshore tower assembly having a support frame structure arranged to be disposed on the bed of a body of water, said support frame structure comprising:
a plurality of legs;
a plurality of piling guides disposed around and connected to a lower portion of at least one of said legs, said piling guides being operable to telescopingly receive piling members for anchoring said frame structure to the bed of said body of water; and
a buoyancy unit disposed at the lower portion of at least said one of said legs, said buoyancy unit including
outer wall means operably connected to said piling guides and including top and bottom wall portions to define a chamber encircling said one of said legs,
a plurality of load-transfer fins radiating outwardly from and connected with said one of said legs, with each fin being connected with a piling guide, said transfer fins being arranged to divide said chamber into a plurality of circumferentially displaced buoyancy cells disposed around said one of said legs, and
transfer forces in a generally uniform manner between said one of said legs and said piling guides connected therewith by way of said fins,
said outer wall means being apertured to render said cells of less than water-tight construction, and
a solid buoyancy substance being contained within said buoyancy cells to impart upward forces to said one of said legs.

6. Apparatus according to claim 5 wherein:
said outer wall means is disposed radially within a perimeter defined by said piling guides.

7. Apparatus according to claim 5 wherein:
said outer wall means comprises a plurality of wall sections connected between adjacent ones of said piling guides; and
said load-transfer fins are each directly connected between said one of said legs and one of said piling guides.

8. Apparatus according to claim 7 wherein:
at least one of said wall sections contains an opening receiving a brace member which extends between adjacent ones of said legs.

9. Apparatus according to claim 7 wherein:
said load-transfer fins extend along substantially the entire height of said piling guides; and
said outer wall means extend less than one-half the height of said fins.

10. Apparatus according to claim 7 wherein:
said chamber is apertured to provide communication between said body of water and said cells, and
said solid buoyancy substance comprises polyurethane foam.

11. An offshore tower assembly having a support frame structure arranged to be disposed on a body of water, said support frame structure comprising:
a plurality of legs;
a plurality of piling guides disposed around and connected to a lower portion of at least one of said legs, said piling guides being operable to telescopingly receive piling members for anchoring said frame structure to said bed of said body of water; and
a buoyancy unit disposed at the lower portion of at least said one of said legs, said buoyancy unit comprising
outer wall means operably connected to said piling guides and including top and bottom wall portions defining a chamber encircling said one of said legs,
a plurality of load-transfer fins radiating outwardly from and connected with said one of said legs, with each fin being connected with said outer wall means, said transfer fins being arranged to divide said chamber into a plurality of circumferentially displaced buoyancy cells disposed around said one of said legs, and
transfer forces in a generally uniform manner between said one of said legs and said piling guides connected therewith by way of said fins, and
double-walled, scalloped reinforcing means for reinforcing said outer wall means and impeding water penetration into said cells, said reinforcing means comprising
a plurality of circumferentially displaced first curved plates connected to an inner surface of said outer wall means, and
a plurality of curved bridging plates located circumferentially between said first plates and connected to convex surfaces of said first plates.

12. Apparatus according to claim 11 wherein:
said outer wall means is cylindrically shaped.

13. Apparatus according to claim 12 wherein:
said first curved plates include plates of generally semi-cylindrical shape which extend between said top and bottom wall portions of said chamber and which are substantially uniformly, circumferentially spaced around said inner surface;
said curved first plates have longitudinal edges welded to said inner surface of said cylindrical wall; and
said bridging plates each have longitudinal edges welded to the convex surfaces of adjacently disposed ones of said first curved plates.

14. Apparatus according to claim 12 wherein:
said first curved plates further include curved plates having
one longitudinal edge connected to said inner surface of said cylindrically shaped outer wall means and
another longitudinal edge connected to one side of a respective load-transfer fin.

15. Apparatus according to claim 12 wherein:
said cylindrically shaped outer wall means is located within a perimeter defined by said piling guides.

16. Apparatus according to claim 15 including:
a plurality of connecting plates, each extending outwardly from the outer surface of said cylindrically shaped outer wall means and connected to a piling guide.

* * * * *